United States Patent [19]

Glintz

[11] 4,152,792

[45] May 8, 1979

[54] BED TOILETRY AND BATH BASIN WITH THROWAWAY LINERS

[76] Inventor: Georgia E. Glintz, 2909 University Ave., Des Moines, Iowa 50311

[21] Appl. No.: 852,713

[22] Filed: Nov. 18, 1977

[51] Int. Cl.[2] ..... A47K 3/06; A47K 3/08; A61G 7/04

[52] U.S. Cl. ..... 4/175; 4/177 R; 4/300; 4/DIG. 18; 5/90; 5/414; 5/508

[58] Field of Search ..... 4/112, 113.1, 144.3, 4/173 R, 175, 177 R, 177 CW, 159, 162, 185 R, 185 AB, 300, 144.1, 154, 157, DIG. 18, 1, 145, 146, 148, 149, 3-5; 5/90, 362, 365, 60, 92, 370; 128/295, 369

[56] References Cited

U.S. PATENT DOCUMENTS

| | | | |
|---|---|---|---|
| 2,878,488 | 3/1959 | Doskocil | 4/177 R |
| 3,108,293 | 10/1963 | King | 4/185 R X |
| 3,187,350 | 6/1965 | Steven | 4/177 R |
| 3,559,216 | 2/1971 | Kyte | 4/177 R X |
| 3,733,620 | 5/1973 | Glintz | 4/159 |
| 3,734,058 | 5/1973 | Hightower et al. | 4/177 R X |
| 3,755,830 | 9/1973 | Johns | 4/177 R |
| 4,034,424 | 7/1977 | Budlong | 4/177 R X |
| 4,055,863 | 11/1977 | Duval | 4/177 R X |

*Primary Examiner*—Stuart S. Levy

[57] ABSTRACT

A receptacle as provided for disposition upon a bed and includes a form retentive but foldable body constructed of water impervious material and defining a bottom wall extending between and from whose outer marginal peripherally continuous, integral and upwardly extending peripheral walls project. One of the peripheral walls has a lower opening formed therethrough and a flexible and upwardly opening liner constructed of water impervious material is removably seated in the receptacle, the marginal portion of the liner corresponding to the aforementioned one peripheral wall of the receptacle including a flexible drain outlet neck projectable through the opening formed and the wall of the receptacle remote from the wall having the opening formed therein includes an upwardly opening depression formed therein for seatingly receiving the neck of a person disposed within the receptacle and a plurality of downwardly concave arched support bows are removably supported from and span between opposite side walls of the receptacle with the bows generally paralleling each other and spaced along the length of the receptacle between the notched wall and the wall having the aforementioned opening formed therein. A flexible nontransparent drape is removably disposed over and supported from the bows and the drape includes marginal portions which overlap the exteriors of the side walls of the receptacle between which the bows extend and the wall of the receptacle in which the aforementioned opening is formed.

5 Claims, 9 Drawing Figures

BED TOILETRY AND BATH BASIN WITH THROWAWAY LINERS

BACKGROUND OF THE INVENTION

There are many instances when persons must be given baths while lying on a bed or similar support surface. Although sponge baths are often given in hospitals, sponge baths are not always as complete as may be desired. In addition, some persons required to remain in a prone position while lying on a bed must perform toilet functions and some other persons are incapable of controlling toilet functions.

Accordingly, a need exists for structure whereby persons disposed in prone positions on beds or other suitable supports may be given more complete baths and/or body functions may be performed without soiling the beds.

Although various forms of devices have been heretofore designed for the purpose of enabling bedridden persons to perform toilet functions and other apparatus has been provided for facilitating bathing persons disposed on beds, very few of these previously known structures are capable of adequately affording the capability of bedridden persons to be completely bathed and/or to perform toilet functions.

Examples of some previous devices of the type above set forth and including some of the general structural and operational features of the instant invention are disclosed in U.S. Pat. Nos. 473,065, 890,681, 940,958, 1,468,603, 2,066,400, 2,535,336, 3,377,631 and 3,605,127.

BRIEF DESCRIPTION OF THE INVENTION

The bed toiletry and bath and bath basin assembly of the instant invention includes an upwardly opening receptacle constructed of form retentive but foldable and water impervious material. A flexible upwardly opening liner is provided for disposition within the receptacle and one peripheral wall of the receptacle includes a lower opening formed therethrough and the corresponding marginal portion of the liner includes an elongated flexible drain outlet neck projectable through the aforementioned opening. A plurality of downwardly opening bows are removably supported from and extend between opposite sides of the receptacle and a flexible non-transparent drape is disposed over and supported from the bows with lower marginal portions overlying the outer surfaces of the corresponding walls of the receptacle. In addition, the inner surface of the lower margin of the drape includes a downwardly projecting skirt portion which overlaps the inner surfaces of the corresponding walls of the receptacle. Also, the wall of the receptacle remote from the wall having the drain opening formed therein is provided with an upwardly opening recess for seatingly receiving the back of the neck of a person disposed within the receptacle. Still further, soft water absorbent foot boots are provided to be worn by a person disposed within the receptacle in order to afford additional foot traction to that person on the wet inner surfaces and or the liner.

The main object of this invention is to provide a receptacle in which bedridden persons may be more completely bathed.

Another object of this invention is to provide a receptacle in accordance with the immediately preceding object and which may be used in conjunction with a disposal liner to enable the bedridden person to perform toilet functions.

Still another object of this invention is to provide a receptacle in accordance with the preceding objects and including an elevated non-transparent flexible cover whereby the person disposed within the receptacle may have his or her body portions disposed below the shoulders covered against viewing from the exterior of the receptacle.

A final object of this invention to be specifically enumerated herein to provide an apparatus in accordance with the preceding objects and which will conform to conventional forms of manufacture, be of simple construction and easy to use so as to provide a device that will be economical feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 5, 6, 7, 8, 9:
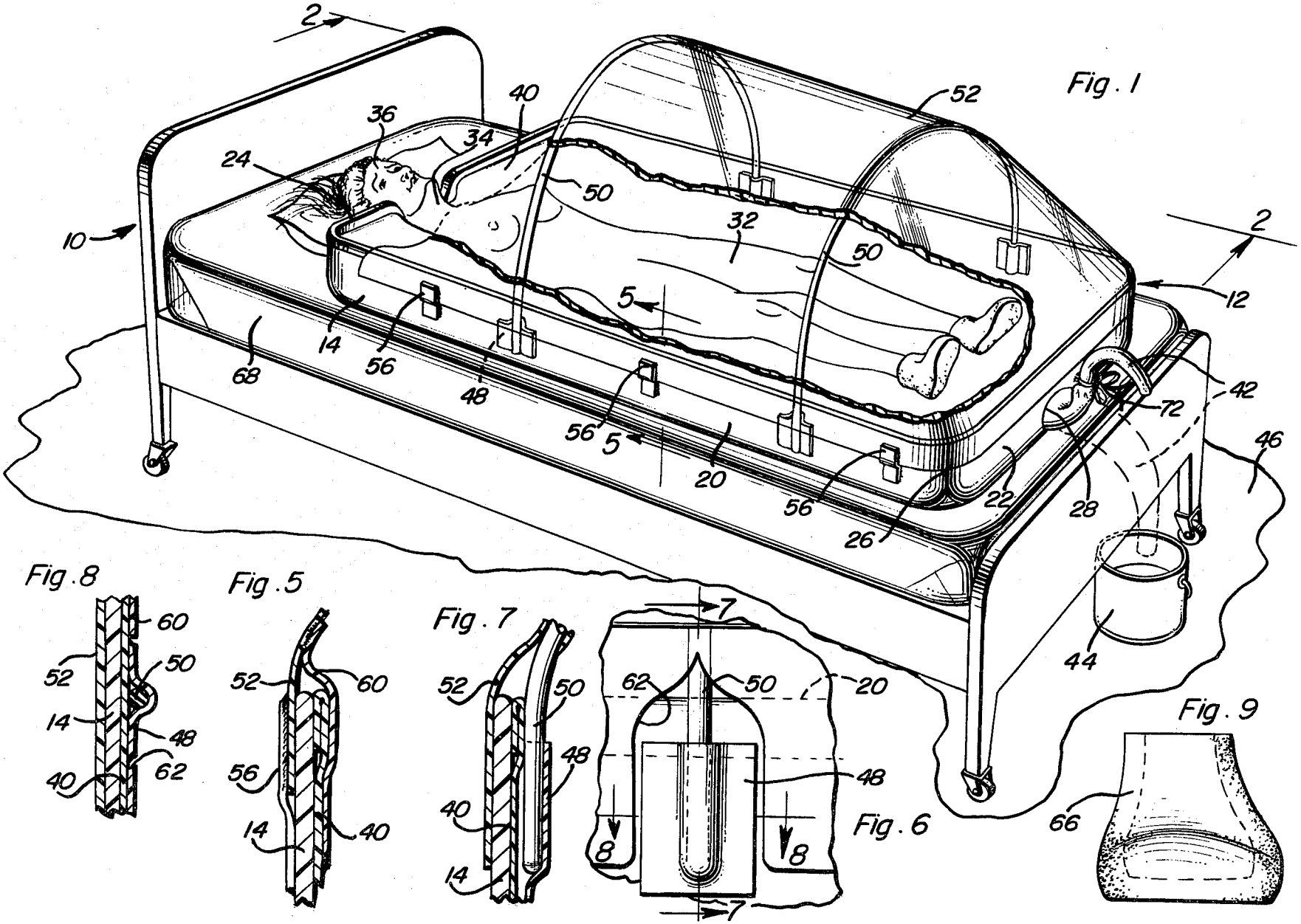
FIG. 1 is a perspective view of the instant invention in operative association with a bed and with a person disposed within the basin or receptacle.
FIG. 5 is an enlarged fragmentary vertical section view taken substantially upon the plane indicated by the section line 5—5 of FIG. 1.
FIG. 6 is a fragmentary elevational view illustrating the manner in which one of the ends of one of the drape supporting bows is supported from the receptacle.
FIG. 7 is a fragmentary vertical sectional view taken substantially upon the plane indicated by the section line 7—7 of FIG. 6.
FIG. 8 is a fragmentary horizontal sectional view taken substantially upon the plane indicated by the section line 8—8 of FIG. 6.
FIG. 9 is a front elevational view of a foot boot to be worn by a user of the instant invention.
Figure 2:
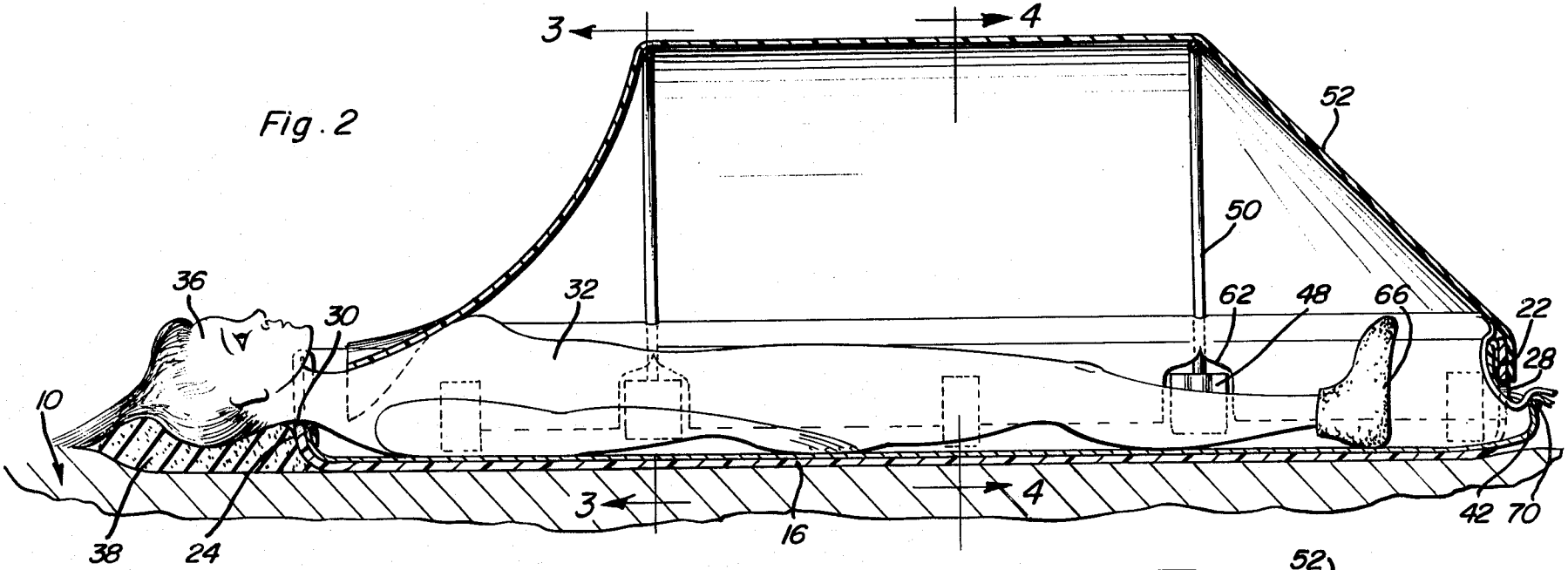
FIG. 2 is an enlarged fragmentary longitudinal vertical sectional view taken substantially upon the plane indicated by the section line 2—2 of FIG. 1.
Figure 4:
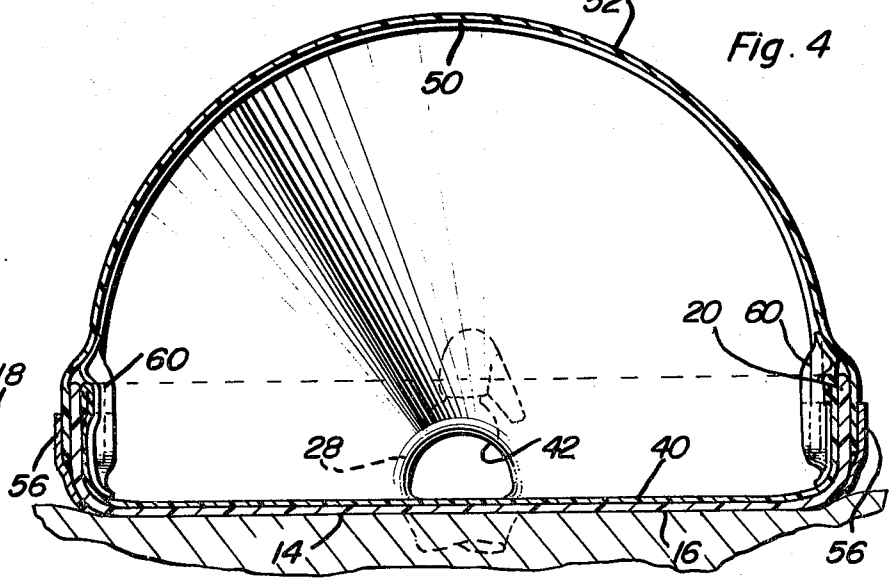
FIG. 4 is a transverse vertical sectional view taken substantially upon the plane indicated by the section line 4—4 of FIG. 2.
Figure 3:
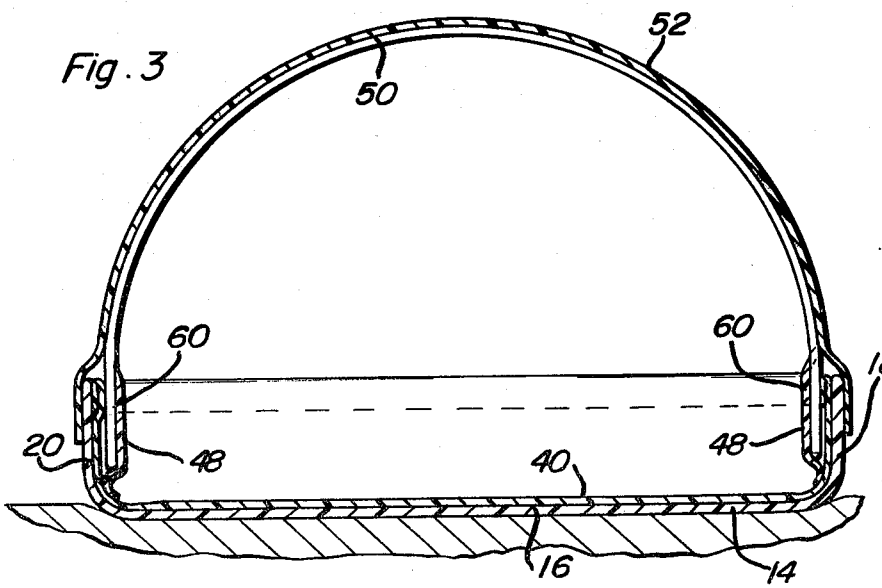
FIG. 3 is a vertical transverse sectional view taken substantially upon the plane indicated by the section line 3—3 of FIG. 2.

Referring now more specifically to the drawings, the numeral 10 generally designates a bed and the numeral 12 generally designates the bed toiletry and bath basin assembly of the instant invention. The assembly 12 includes an upwardly opening receptacle 14 constructed of form retentive, but foldable and water impervious material. The receptacle 14 includes a bottom wall 16 extending between and interconnecting integral upstanding opposite side walls 18 and 20 and opposite end walls 22 and 24. The side walls 18 and 20 generally parallel each other as do the end walls 22 and 24 and the receptacle 14 is therefore generally rectangular in plan shape. However, the four corners of the receptacle 14 are rounded as at 26. Further, the end wall 22 has a lower opening 28 formed therein and the end wall 24 has an upwardly opening notch or recess 30 formed therein.

As may be seen from FIG. 1 of the drawings, the receptacle 14 is disposable on the bed 12 and a person 32 is lengthwise receivable within the receptacle 14 with her neck 34 cradled in the upwardly opening recess or notch 30 and her head 36 disposed outwardly of the end wall 24 and resting upon a pillow 38 disposed on the bed 10.

An upwardly opening shallow liner 40 conforming to the shape of the interior of the receptacle 14 is received within the latter and that portion of the liner 40 opposing the inner surface of the end wall 22 has an elongated flexible drain outlet neck 42 formed integrally therewith and which is removably projectable through the opening 28. A drain receptacle 44 may be disposed on the floor 46 at the corresponding end of the bed 10 to receive drainage from the liner 40 through the neck 42.

The side walls 18 and 20 of the receptacle 14 include upwardly opening socket mounts 48 spaced therealong and the lower ends of downwardly opening arched bows 50 are removably receivable in the upwardly opening socket mount 48. Further, a flexible drape 52 constructed of non-transparent material is provided and is disposed over and supported from the bows 50 with the opposite side marginal edge portions of the drape 52 overlapping the exterior surfaces of the side walls 18 and 20. In addition, the marginal portion of the drape 52 corresponding to the end wall 22 drapes over the exterior of the end wall 22.

The side walls 18 and 20 include longitudinally spaced adhesive tabs 56 which overlap and are adhesively secured to adjacent marginal portions of the drape 52 whereby the latter may be removably secured in position over the bows 50. Further, the marginal portions of the drape 52 corresponding to the side walls 18 and 20 and the end wall 22 include a continuous depending skirt 60 extending therealong and secured to the inner surface of the lower marginal portions thereof. The skirt 60 overlap the inner surfaces of the side walls 18 and 20 and the end wall 22. The skirt 60, however, has a plurality of windows 62 formed therein along opposite sides of the receptacle 14 to receive the lower ends of the bows 50 therethrough.

The receptacle 14, the liner 40, the socket mounts 48, the bows 50 and the drape 52 may all be constructed of plastic material. Further, the liner 40 is of lightweight construction and inexpensive to produce and therefore is to be considered as disposable.

With attention invited more specifically to FIG. 9 of the drawings, there may be seen a foot boot 66 which is hollow and may be slipped onto the feet of the user 32. The boot 66 is constructed of soft, flexible sponge-like water absorbent material and may therefore be worn by the person 32 in order to be afforded additional foot traction against the wetted inner surfaces of the liner 40. Further, the foot boot 66 may be worn by the person 32 while wetted so as to soften the skin upon the feet of the user 32. Also, the foot boots 66 may be wetted with medicated liquid, if desired.

When the person 32 is disposed within the receptacle 14, the person 32 rests comfortably inasmuch as the receptacle 14, although being constructed of shape retentive material, is foldable and thus capable of conforming to the contours of the mattress 68 of the bed 10 with the weight of the person 32 on the mattress 68. In addition, the pillow 38 provides ample support for the person's head 36.

In use, the liner 40 is disposed within the receptacle 14 and the user 32 is then placed within the liner 14. The assembly 12 may be utilized to perform complete bathing operations on the person 32 without wetting the bed and water and soap solution utilized to wash the person 32 may drain from within the liner 14 through the neck 42 and into the receptacle 44. Still further, if it is necessary for the person 32 to perform toilet functions, the liner 14 may be readily rinsed from the interior thereof and drained through the neck 42.

The drape 52 msy be used to obscure the portions of the body of the person 32 beneath the drape 52 and it is envisioned that the assembly 12 may be very useful in treating burned patients. Of course, in some instances, a disposable fabric sheet may be placed between the person 32 and the inner surface of the liner 40.

In any event, the liner 40 serves to line the basin or receptacle 14 and to maintain the interior thereof clean. Further, by using disposable liners 40 the person 32 is assured of having all surfaces of the assembly 12 with which her body will normally contact clean each time the liner 40 is changed. Also, the receptacle 14 includes an anchor tie assembly 70 secured to the central portion of the exterior of the end wall 22 adjacent the opening 28 and the tie assembly 70 may be used to tie closed and elevate the neck 42 whereby water or other liquids within the liner may be retained therein against drainage therefrom through the neck 42.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A receptacle for containing a person to have a bed bath and for performing toilet functions, said receptacle including a form retentive, but foldable, body constructed of water impervious material and defining a bottom wall extending between and from whose outer margin peripherally continuous, integral and upwardly extending opposite side and end walls project, one of said peripheral walls having an opening formed through a lower portion thereof, and a flexible and upwardly opening liner constructed of water impervious material removably seated in and conforming, substantially, to the interior shape of said receptacle, the marginal portion of said liner corresponding to said one peripheral wall including an elongated flexible drain outlet neck projectable through said opening, a plurality of downwardly concave arched support bows removably supported from and spanning said receptacle between opposite side walls thereof with said bows generally paralleling each other and spaced along the length of said receptacle between said one wall and the wall opposite said one wall, and a flexible non-transparent drape removably disposed over and supported from said bows, said drape including marginal portions overlapping the exteriors of one of said end walls and said opposite side walls, said drape marginal portions include skirt portions projecting downwardly from the inner surfaces thereof spaced above the corresponding marginal edges of said drape and lapped over the inner surface of said one end wall and said opposite side walls.

2. The combination of claim 1 wherein said opposite side walls and said drape include coacting fastening means operative to releasably secure said drape marginal portions to said side walls.

3. The combination of claim 1 including a pair of foot boots to be worn on the feet of said person, said foot boots being constructed of soft flexible and water absorptive material adapted to afford foot traction between said feet and said liner, even when the exterior of the latter is wet.

4. The combination of claim 3 wherein the peripheral wall remote from said one wall includes an upwardly opening depression formed therein adapted to seatingly receive the neck of a person disposed in said receptacle.

5. The combination of claim 1 wherein the peripheral wall remote from said one wall includes an upwardly opening depression formed therein adapted to seatingly receive the neck of a person disposed in said receptacle.

* * * * *